US006857295B2

(12) United States Patent
Hansen et al.

(10) Patent No.: US 6,857,295 B2
(45) Date of Patent: Feb. 22, 2005

(54) TUB MOUNTED, VERTICALLY ORIENTED PUMP

(75) Inventors: Ted L. Hansen, Pella, IA (US); Daryl T. Johnson, Grinnell, IA (US); William R. White, Newton, IA (US); Evan R. Vande Haar, Pella, IA (US); Timothy D. Dorenkamp, Newton, IA (US)

(73) Assignee: Maytag Corporation, Newton, IA (US)

( * ) Notice: Subject to any disclaimer, the term of this patent is extended or adjusted under 35 U.S.C. 154(b) by 277 days.

(21) Appl. No.: 10/096,229

(22) Filed: Mar. 12, 2002

(65) Prior Publication Data

US 2003/0172693 A1 Sep. 18, 2003

(51) Int. Cl.[7] ..... D06F 39/10

(52) U.S. Cl. ..... 68/3 R; 68/207; 68/18 F; 134/104.2; 134/104.4

(58) Field of Search ..... 68/3 R, 13 R, 68/18 F, 207; 134/57 D, 56 D, 58 D, 104.4, 104.2, 155, 186

(56) References Cited

U.S. PATENT DOCUMENTS

| | | | | | |
|---|---|---|---|---|---|
| 1,645,869 | A | * | 10/1927 | Murdoch | 134/143 |
| 1,695,279 | A | * | 12/1928 | Gies | 68/133 |
| 2,023,013 | A | | 12/1935 | Faber et al. | |
| 2,167,466 | A | * | 7/1939 | Shawhan et al. | 261/36.1 |
| 2,360,278 | A | * | 10/1944 | Robertson | 68/18 F |
| 2,412,078 | A | * | 12/1946 | Breckenridge et al. | 68/139 |
| 2,413,954 | A | * | 1/1947 | Conterman | 210/451 |
| 2,586,508 | A | * | 2/1952 | Brotman | 210/437 |
| 2,592,597 | A | * | 4/1952 | Pengelly | 68/183 |
| 2,616,280 | A | * | 11/1952 | Hermann | 68/183 |
| 2,645,109 | A | * | 7/1953 | Smith | 68/23.4 |
| 2,744,466 | A | * | 5/1956 | Difford | 210/416.4 |
| 2,854,144 | A | * | 9/1958 | Smith | 210/382 |
| 2,900,080 | A | * | 8/1959 | Worst et al. | 210/171 |
| 2,900,812 | A | | 8/1959 | Smith | |
| 2,901,294 | A | | 8/1959 | Smith | |
| 2,961,862 | A | | 11/1960 | Smith | |
| 2,976,710 | A | | 3/1961 | Sisson et al. | |
| 2,989,027 | A | * | 6/1961 | Schouw | 118/64 |
| 3,017,030 | A | | 1/1962 | Alexander et al. | |
| 3,102,409 | A | * | 9/1963 | Paganini | 68/18 D |
| 3,136,254 | A | * | 6/1964 | Douglas | 415/206 |
| 3,327,722 | A | * | 6/1967 | Nolte | 134/111 |
| 3,669,132 | A | * | 6/1972 | Mamrose | 134/58 D |
| 3,953,146 | A | * | 4/1976 | Sowards | 415/121.1 |
| 4,382,804 | A | * | 5/1983 | Mellor | 95/270 |
| 4,411,664 | A | | 10/1983 | Rickard et al. | |
| 4,485,645 | A | * | 12/1984 | Mulder et al. | 68/18 F |
| 4,904,166 | A | | 2/1990 | Wasemann | |
| 5,127,417 | A | * | 7/1992 | Tromblee et al. | 134/111 |
| 5,307,651 | A | | 5/1994 | Felzer | |
| 5,484,282 | A | * | 1/1996 | Trawoger et al. | 433/92 |
| 6,418,943 | B1 | * | 7/2002 | Miller | 134/104.1 |
| 6,584,812 | B1 | * | 7/2003 | Killane | 68/18 F |

FOREIGN PATENT DOCUMENTS

| | | | |
|---|---|---|---|
| GB | 2038372 | * | 7/1980 |
| JP | 52-59963 | * | 5/1977 |
| JP | 402119898 A | | 5/1990 |
| JP | 2002-103172 | * | 4/2002 |

* cited by examiner

*Primary Examiner*—Frankie L. Stinson
(74) *Attorney, Agent, or Firm*—McKee, Voorhees & Sease, P.L.C.

(57) ABSTRACT

The present invention includes a washing machine having a water cavity position beneath an outer tub and a pump mounted above the water cavity with an impeller extending downwardly into the water cavity. Preferably, the water cavity is integral with the outer tub and the water cavity includes a service port located along the bottom of the water cavity.

8 Claims, 3 Drawing Sheets

TUB MOUNTED, VERTICALLY ORIENTED PUMP

BACKGROUND OF THE INVENTION

This invention relates to washing machines. More specifically, this invention relates to a washing machine having a tub-mounted and vertically oriented pump.

Washing machines typically include a motor-pump assembly. The pump is used to remove water from the machine. Pumps may include impellers used for forcing water in a desired direction such as through an outlet. Many prior art washing machines mount the pump motor below the water cavity, through which water is pumped from the machine. One problem with this configuration is that sediment and other material passing through the water cavity settle on top of the pump and motor. This can result in material or debris becoming lodged into the pump resulting in adverse effects on the performance of the washing machine. Service personnel may be required to remove the sediment or material or fix any resulting damage.

Yet another problem in the prior art is that the pump and water cavity are not located near the outer tub. The further removed the pump and water cavity are from the outer tub, the more hosing and/or piping is needed to make the necessary connections between the outer tub and the water cavity and between the water cavity and the pump. These connections provide additional opportunities for material or debris to collect, create blockages, or otherwise interfere with the proper operation of the washing machine.

A further problem is that due to the location of the pump and motor, in order to access the water cavity for servicing, the washing machine must be disassembled so that the water cavity can be inspected and cleaned of debris if necessary.

Therefore, a primary object of the present invention is the provision of an improved washing machine.

A further object of the present invention is the provision of a washing machine that is less susceptible to clogging from debris.

A still further object of the present invention is the provision of a washing machine that provides greater accessibility for inspection and cleaning of its water cavity.

Yet another object of the present invention is the provision of a washing machine that provides improved accessibility to its pump motor.

A further object of the present invention is the provision of a washing machine that protects the impeller and motor bearings from sediment and other objects.

Another object of the present invention is the provision of a washing machine that reduces opportunities for sediment build-up between the tub and water cavity and/or between the water cavity and the pump.

These and other objects, features, or advantages of the present invention will become apparent from the specification and the claims.

BRIEF SUMMARY OF THE INVENTION

The present invention relates to a washing machine having a tub-mounted, vertically oriented dropped-impeller pump. According to the present invention, the washing machine has an outer tub, a water cavity positioned beneath the outer tub, and a pump mounted on an upper surface of the water cavity and outside of the outer tub, the pump impeller extending downward into the water cavity. The placement of the pump provides the advantage of debris settling away from the pump and its impeller, thereby protecting the pump and the impeller from damage. The pump can be located towards the front of the washing machine making it more accessible for servicing.

The present invention also provides for a washing machine having a service port positioned along a lower surface of the water cavity for providing access to the water cavity. This placement of the service port makes the water cavity easier to inspect and clean. In addition, the water cavity is formed integral with the outer tub to decrease susceptibility to debris and to improve serviceability.

The present invention also provides for a method of servicing a washing machine where the washing machine has a water cavity positioned beneath an outer tub, a pump mounted on an upper surface of the water cavity, and an impeller extending downward into the water cavity. The method includes opening a service port located at the bottom of the water cavity and then accessing the water cavity through the service port. This method of servicing is convenient and less labor intensive than other methods. The present invention also provides for inspecting the water cavity, cleaning the water cavity, and/or accessing the pump.

DETAILED DESCRIPTION OF THE INVENTION

Figure 1:
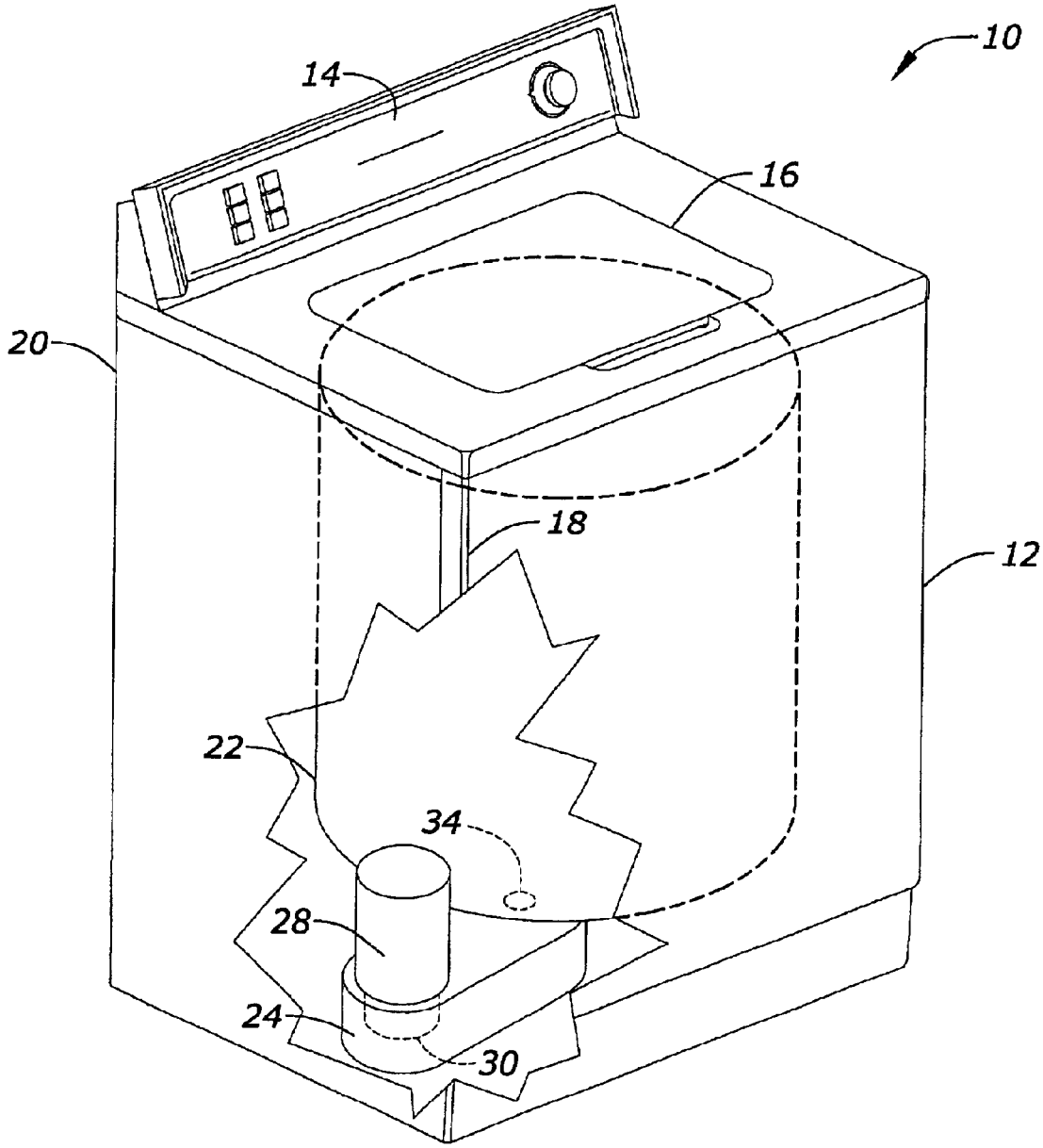
FIG. 1 is a perspective view of a washing machine according to the present invention.

The present invention provides for an improved washing machine having a tub-mounted, vertically oriented drop-impeller pump. FIG. 1 shows a perspective view of the washing machine 10 with a portion cut out. The washing machine 10 includes a cabinet or housing 12 and a control panel 14. The washing machine 10 shown includes a lid 16. Although a top-loading washing machine is shown, the present invention can also be used on a front loading washing machine. The washing machine 10 has a front side 18 and a rear side 20. Within the washing machine 10 is an outer tub 22. Water from the outer tub 22 flows into the water cavity 24 through a water cavity inlet 34.

A pump 28 is mounted outside the water cavity 24 and nearer the front end 18 of the washing machine 10 than the rear end 20 of the washing machine 10. Locating the pump 28 towards the front end 18 of the washing machine 10 provides easier access to service the pump 28. The pump 28 is a dropped impeller pump, having an impeller 30 that extends downwardly into the water cavity 24.

Figure 2:
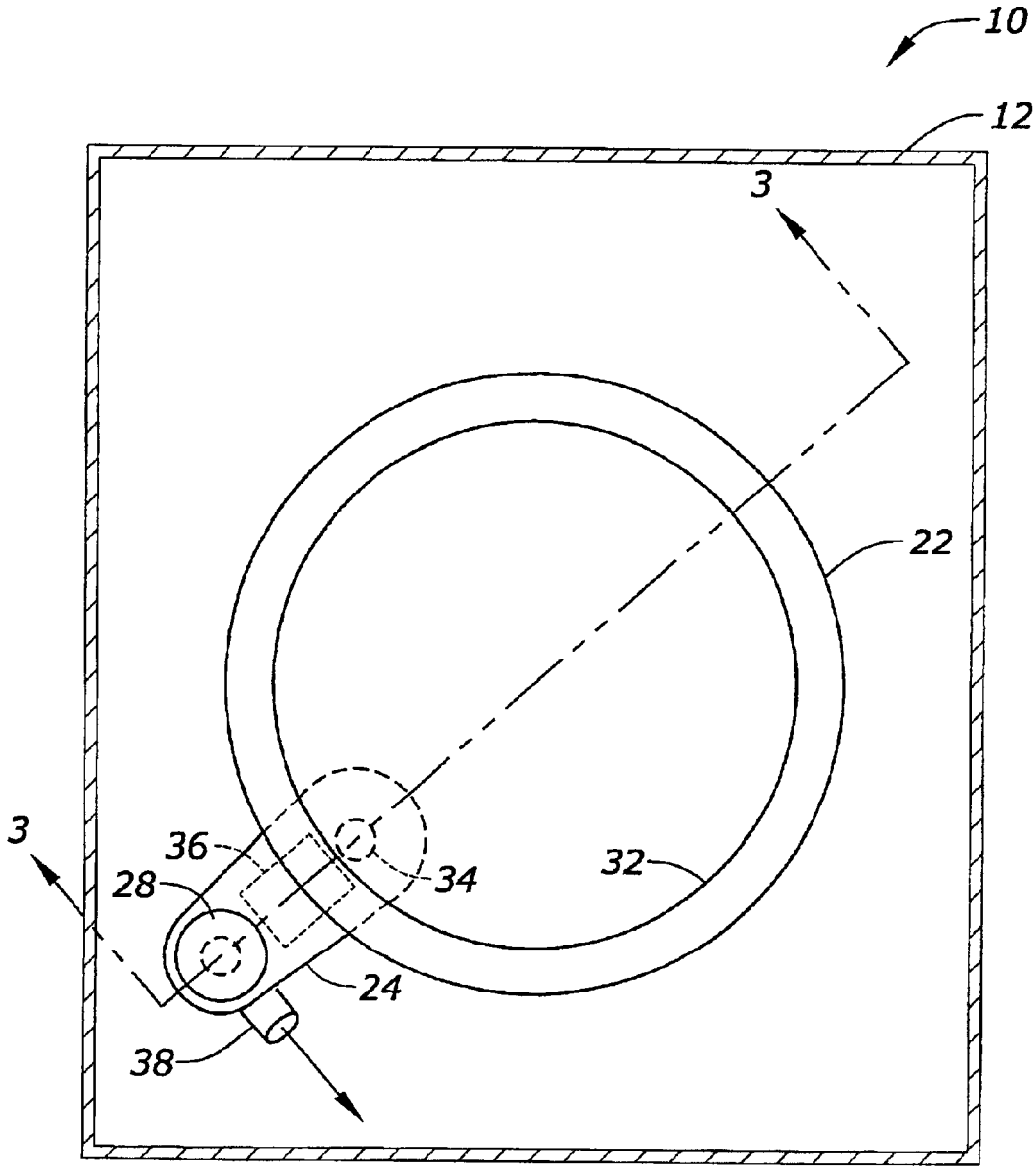
FIG. 2 is a top view of the washing machine and its tub and pump assembly according to the present invention.

FIG. 2 shows a top view of the washing machine assembly of the present invention. In FIG. 2, both an outer tub 22 and a perforated inner tub 32 are shown. An inlet 34 into the water cavity 24 allows water to flow into the water cavity. The water cavity also includes a service port 36. The service port 36 is located on the bottom of the water cavity 24 so that material or debris accumulated at the bottom of the cavity can be accessed and removed. In operation, and as shown, the service port 36 is sealed to prevent leakage. The service port 36, however, can be unsealed or opened to access the water cavity 24. The present invention contemplates that access to the pump 28, or portions thereof can also be provided through the service port 36.

An outlet port 38 connected to the pump 28 allows water to be expelled such as through a hose (not shown) leading to the exterior of the washing machine 10. Thus, water is removed from the outer tub 22 of the washing machine 10, through the inlet port 34 and into the water cavity 24. The pump 28 moves water from the water cavity, releasing it through the outlet port 38.

Figure 3:
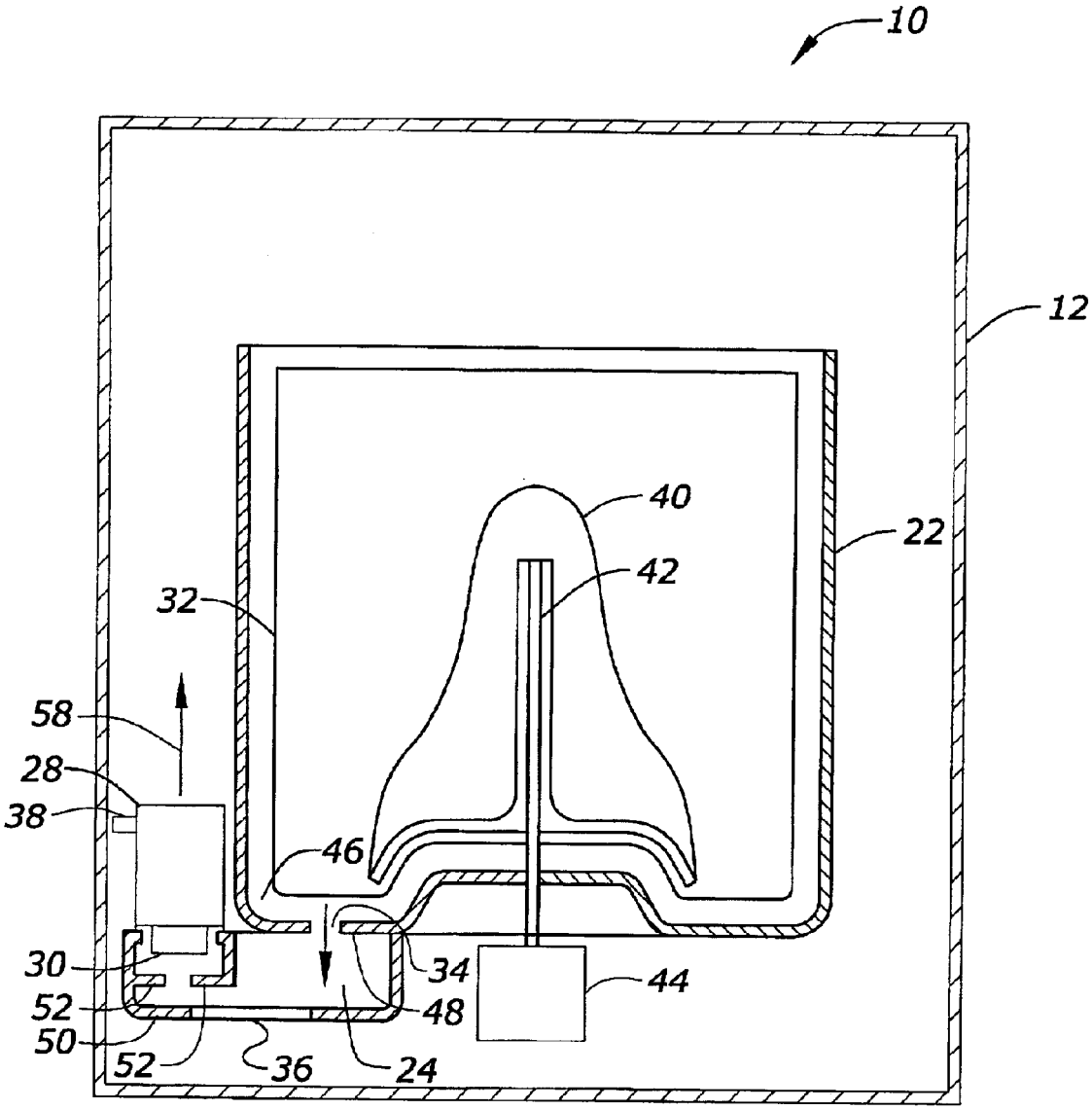
FIG. 3 is a sectional view taken along line 3—3 of FIG. 2 showing the motor and pump assembly of the present invention.

The cross-sectional view of FIG. 3 is taken along line 3—3 of FIG. 2. In FIG. 3, the washing machine 10 includes an agitator 40 that is vertically mounted over a vertically mounted drive shaft 42 and within perforated inner tub 32. The drive shaft 42 is driven by a drive motor 44. There is a space or gap 46 between the inner tub 32 and the outer tub 22 that leads to an inlet port 34 to the water cavity 24, the water cavity 24 being located below the outer tub 22 and being integral therewith. The water cavity 24 has a service port 36 that is normally covered or otherwise sealed. A motor and pump 28 with a pump impeller 30 extends downwardly into the water cavity 24. The water cavity 24 has an upper surface 48 and a lower surface 50. In addition, inner walls 52 of the water cavity 24 provide a pumping cavity and protection of the pump impeller 30 from debris.

At the completion of each wash and rinse cycle, water exits the outer tub 22 and enters the water cavity 24 through the inlet port 34. Debris or other material can also exit the outer tub 22 and enter the water cavity 24 through inlet port 34. As the water cavity 24 is below the outer tub 22, gravitational forces will aid in settling debris or other material along the lower surface 50 of the water cavity 24. Preferably, the outer tub 22 is integral with the water cavity 24 to reduce any obstruction of the flow of debris, sediment, or other material.

According to the present invention, the service port 36, although normally sealed, can be opened such that sediment, debris, or other materials can be removed from the water cavity 24. Opening of the service port 36 includes opening by removal of a portion of the water cavity 24 or otherwise so that access to the water cavity 24 can be provided. A service port lid or cover (not numbered) normally closes or otherwise seals the service port 36.

Because sediment, debris or other material collects at the bottom surface 50 of the water cavity 24, the pump impeller 30 remains at least partially protected from damage that could be caused by this debris. The interior sidewalls 52 in the water cavity 24 and below the impeller 30 can also further protect the pump impeller 30 from being damaged by debris.

The structure of the present invention provides not only additional protection for the pump impeller 30, but also provides for improved accessibility and servicing of the washing machine 10. For example, according to a method of the present invention, servicing of the washing machine 10 for purposes such as repair, maintenance, or inspection includes the step of opening the service port 36 located along the lower surface 50 of the water cavity 24 and then accessing the water cavity 24 through the service port 36. This step of accessing can include visually accessing the water cavity 24 as well as otherwise accessing the water cavity 24 for purposes such as cleaning the water cavity 24, inspecting the water cavity 24, or accessing the pump 28 or pump impeller 30 through the water cavity 24.

The present invention contemplates numerous variations in structure and methodology. For example, the washing machine 10 can be a vertical axis washing machine as shown as well as a horizontal axis washing machine. Where the washing machine 10 is a horizontal axis washing machine, the present invention contemplates modification to the geometry of the washing machine 10 while maintaining the pump 28 with the pump impeller 30 extending downward into the water cavity 24. The pump impeller 30 extends downward either completely or substantially vertically or at an angle so that debris such as sediment or other material settles to a portion of the water cavity 24 that is away from the pump 28 and its propeller 30 and that is easily accessible through a service port 36.

Thus, a method and apparatus for a washing machine having a water cavity positioned beneath an outer tub and a pump mounted above the water cavity has been disclosed. The present invention contemplates variations and equivalents within the spirit and scope of the invention.

What is claimed is:

1. A washing machine comprising:

an outer tub;

an inner tub disposed within the outer tub;

a water cavity positioned beneath the outer tub and formed integral with the outer tub;

a pump mounted on top of the water cavity and outside of the outer tub, the pump having an impeller extending downwardly into the water cavity;

a service port positioned at a lower surface of the water cavity for providing access to the water cavity for removing debris.

2. The washing machine of claim 1 wherein the washing machine has a front end and a rear end, the pump being mounted nearer the front end than the rear end.

3. The washing machine of claim 1 wherein the washing machine is a vertical axis washing machine.

4. The washing machine of claim 1 wherein the water cavity includes an outlet port for directing water away from the washing machine.

5. A vertical axis washing machine having an outer tub and an inner tub disposed within the outer tub, the inner tub adapted to spin on a vertical axis, comprising:

a water cavity positioned beneath the outer tub such that debris settles into the water cavity;

a pump mounted on an upper surface of the water cavity and having an impeller extending downwardly into the water cavity; and a service port positioned at a lower surface of the water cavity for providing access to the water cavity for removing debris.

6. The vertical axis washing machine of claim 5 wherein the water cavity is formed integral with the outer tub.

7. The vertical axis washing machine of claim 5 wherein the washing machine has a front end and a rear end, the pump being mounted nearer the front end than the rear end.

8. The washing machine of claim 5 wherein the water cavity includes an outlet port for directing water away from the washing machine.

* * * * *